US007131779B1

(12) United States Patent
Lin

(10) Patent No.: US 7,131,779 B1
(45) Date of Patent: Nov. 7, 2006

(54) ACTUATING CONTROL DEVICE

(75) Inventor: Yu-Hsien Lin, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 11/435,258

(22) Filed: May 16, 2006

(30) Foreign Application Priority Data

Feb. 17, 2006 (TW) ..... 95105347 A

(51) Int. Cl.
*B41J 25/304* (2006.01)

(52) U.S. Cl. ..... 400/320; 400/279; 400/283; 347/19

(58) Field of Classification Search ..... 400/319, 400/320, 279–284; 347/19
See application file for complete search history.

(56) References Cited

U.S. PATENT DOCUMENTS 4,741,634 A * 5/1988 Nozaki et al. ..... 400/120.11
5,207,520 A * 5/1993 Tanaka ..... 400/279
6,619,778 B1 * 9/2003 Igarashi ..... 347/19
6,955,412 B1 * 10/2005 Hin ..... 347/19

* cited by examiner

*Primary Examiner*—Minh Chau

(57) ABSTRACT

An actuating control device for use between a printer head and an actuating and transmitting device includes a path planning unit, a feedback unit, a proportional-integral controller and a feed forward controller. The path planning unit issues a position command value and a speed command value. The feedback unit generates a position feedback signal and a speed feedback signal according to the position and the speed of the printer head. The proportional-integral controller generates a first control signal according to the difference between the position command value and the position feedback signal and the difference between the speed command value and the speed feedback signal. The feed forward controller generates a second control signal according to a computation on the speed command value. The printer head is driven to move by the actuating and transmitting device in response to the first control signal and the second control signal.

7 Claims, 3 Drawing Sheets

ACTUATING CONTROL DEVICE

The present invention relates to an actuating control device, and more particularly to an actuating control device for use between a printer head and an actuating and transmitting device of a printing apparatus.

BACKGROUND OF THE INVENTION

Referring to FIG. 1, a schematic diagram of some components contained in an inkjet printer is illustrated. The supporting pedestal 11 of the inkjet head 10 is driven by the motor 12, the gear set 13 and the belt 14 to linearly move along the gliding rod 19 back and forth. In such manner, the inkjet head 10 is moved to the desired positions for performing the printing tasks. For actually realizing the position of the inkjet head 10 by the control unit (not shown in this drawing), the optical encoder 15 which is carried on the supporting pedestal 11 generates a position feedback signal and a speed feedback signal according to the graduations of the optical ruler 16. In response to the position feedback signal and the speed feedback signal, the control unit generates a control signal to control movement of the inkjet head 10.

Please refer to FIG. 2, which is a functional block diagram illustrating the control unit of the inkjet printer. According to a computation associated with the position command value and the speed command value outputted from the path planning unit 20, the proportional-integral-differential (PID) controller 21 issues a control signal to the actuating device 22 such as the motor 2 described above. An exemplified control signal is a pulse width modulation (PWM) signal. In response to the control signal, the mechanical installation 23 including for example the gear set 13, the belt 14 and the inkjet head 10 as described above is driven by the actuating device 22. The position feedback signal and the speed feedback signal generated by the feedback unit 24, which includes the optical encoder 15 and the optical ruler 16 as described above, are fed back to the input end of the PID controller 21. According to the difference between the position command value and the position feedback signal (i.e. the position error signal) and the difference between the speed command value and the speed feedback signal (i.e. the speed error signal), the PID controller 21 issues the control signal to control the driving force of the actuating device 22.

As previously described, the control signal is generated from the PID controller 21 according to the position error signal and the speed error signal. Under this circumstance, these error signals should be large enough to generate sufficient voltage of the control signal to drive the actuating device 22. Therefore, the control unit of the inkjet printer has some drawbacks such as a slow response speed and a large speed error signal.

In views of the above-described disadvantages resulted from the prior art, the applicant keeps on carving unflaggingly to develop an actuating control device according to the present invention through wholehearted experience and research.

SUMMARY OF THE INVENTION

It is an object of the present invention to provide an actuating control device with increased response speed and the enhanced systematic stability.

In accordance with an aspect of the present invention, there is provided an actuating control device for use between a printer head and an actuating and transmitting device of a printing apparatus. The actuating control device includes a path planning unit, a feedback unit, a proportional-integral controller and a feed forward controller. The path planning unit issues a position command value and a speed command value. The feedback unit is communicated with the printer head and generates a position feedback signal and a speed feedback signal according to the position and the speed of the printer head. The proportional-integral controller is communicated with the path planning unit, the feedback unit and the actuating and transmitting device, and generates a first control signal to be transmitted to the actuating and transmitting device according to the difference between the position command value and the position feedback signal and the difference between the speed command value and the speed feedback signal. The feed forward controller is communicated with the path planning unit and the actuating and transmitting device, and generates a second control signal to be transmitted to the actuating and transmitting device according to a computation on the speed command value. The printer head is driven to move by the actuating and transmitting device in response to the first control signal and the second control signal.

In an embodiment, the feedback unit is communicated with an optical encoder and an optical ruler for the printer head, and the optical encoder and the optical ruler respond to the position and the speed of the printer head.

In an embodiment, the first control signal issued from the proportional-integral controller is obtained by means of an equation: the first control signal=kp×(the speed command value−the speed feedback signal)+ki×(the position command value−the position feedback signal), where kp and ki are gain values of the proportional-integral controller.

In an embodiment, the second control signal issued from the feed forward controller is obtained by means of an equation: the second control signal=c1×the speed command value+c2, where c1 and c2 are constants determined from the system identification involving the actuating and transmitting device.

In an embodiment, the actuating and transmitting device comprises a DC motor and a transmission mechanism.

In an embodiment, the transmission mechanism comprises a gear set and a transmission belt.

In an embodiment, the printer head is an inkjet printer.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
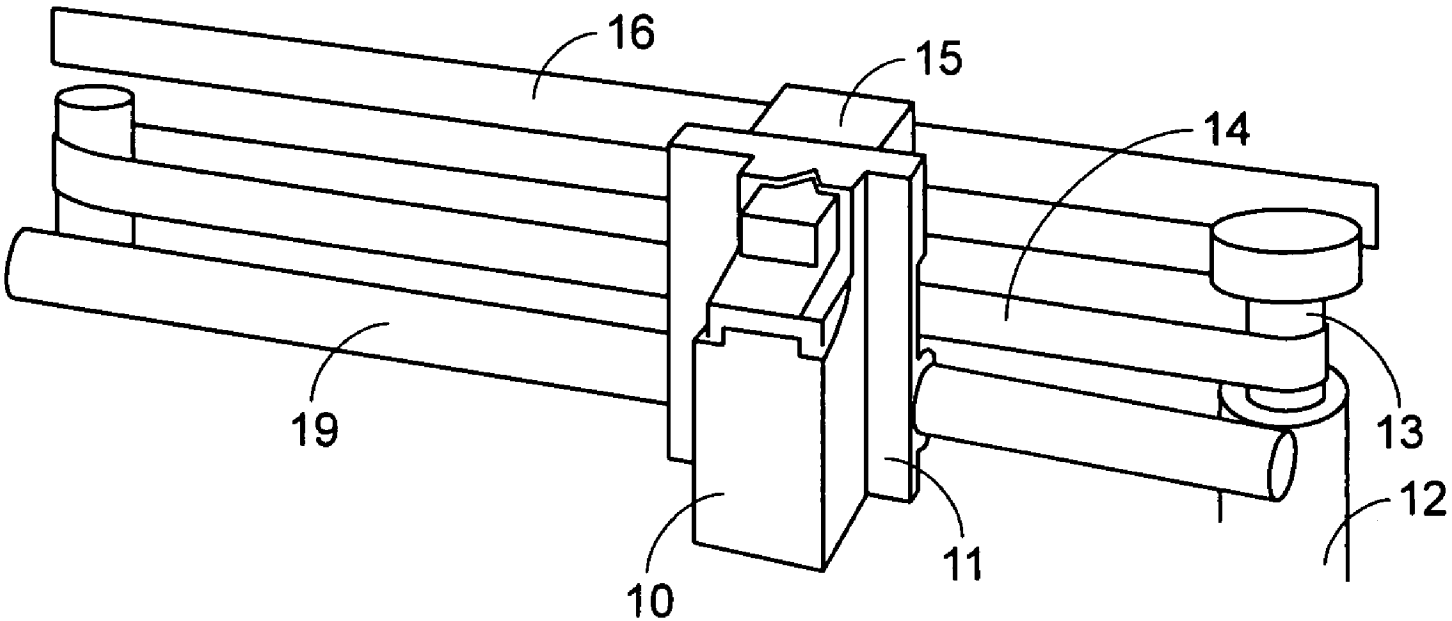
Fig.1 PRIOR ART
FIG. 1 is a schematic diagram illustrating some internal components including in a typical inkjet printer.
Figure 2:
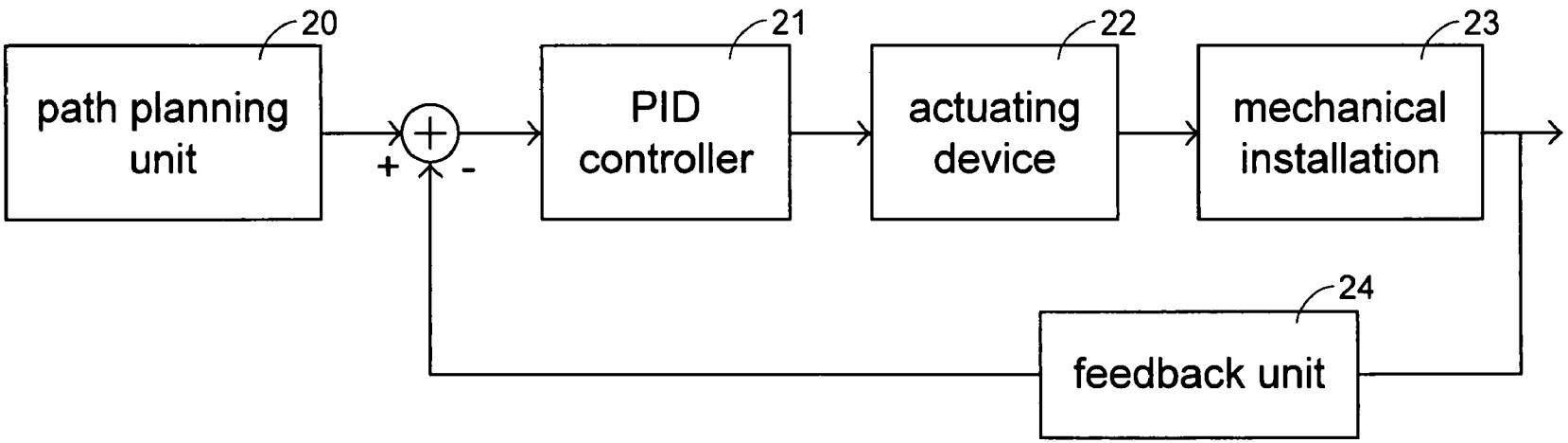
Fig.2 PRIOR ART
FIG. 2 is a functional block diagram illustrating the control unit of the inkjet printer.
Figure 3:
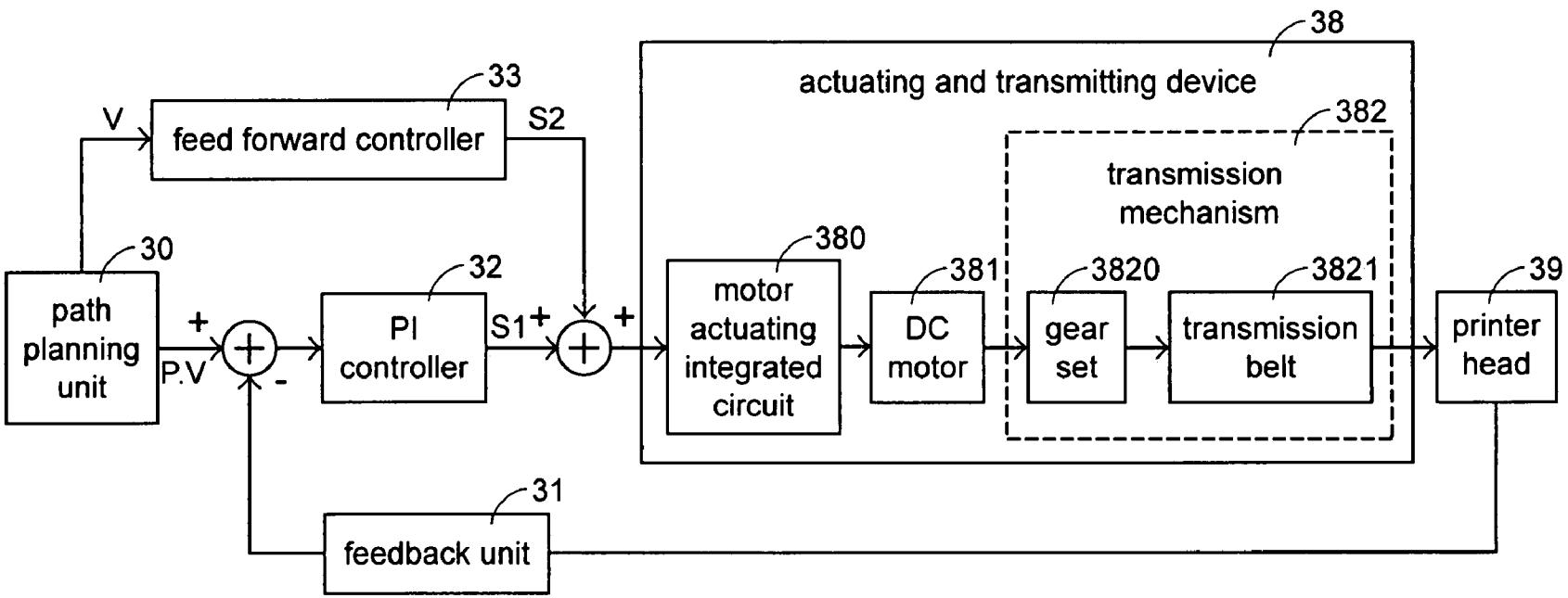
FIG. 3 is a functional block diagram illustrating an actuating control device for actuating an inkjet head according to a preferred embodiment of the present invention.

Referring to FIG. 3, a functional block diagram of an actuating control device for actuating an inkjet head of an inkjet printer or an inkjet-type multifunction peripheral according to a preferred embodiment of the present invention is illustrated. The printer head actuating control device as shown in FIG. 3 is applicable to an inkjet printer or an inkjet multifunction peripheral. The printer head actuating control device comprises a path planning unit 30, a feedback unit 31, a proportional-integral (PI) controller 32 and a feed forward controller 33. The operation principle of the path planning unit 30 is similar to that described in FIG. 2, and is not intended to be redundantly described herein. The path planning unit 30 issues a position command value P and a speed command value V. According to the actual position and speed of the printer head 39, the feedback unit 31 generates a position feedback signal Pf and a speed feedback signal Vf. According to the difference between the position command value P and the position feedback signal Pf (i.e. the position error Pd) and the difference between the speed command value V and the speed feedback signal Vf (i.e. the speed error Vd), the PI controller 32 issues a first control signal S1. Whereas, the feed forward controller 33 performs a computation on the speed command value V to generate a second control signal S2. The first control signal S1 and the second control signal S2 are transmitted to the actuating and transmitting device 38. In response to the first control signal S1 and the second control signal S2, the printer head 39 is driven by the actuating and transmitting device 38 to move.

The second control signal S2 issued from the feed forward controller 33 is equal to the sum of the speed command value V multiplied by a first constant c1 and a second constant c2, i.e. S2=c1×V+c2. The constants c1 and c2 can be determined from the system identification involving the actuating and transmitting device 38. The first control signal S1 issued from the P1 controller 32 is obtained by means of an equation S1=kp×(the speed command value V−the speed feedback signal Vf)+ki×(the position command value P−the position feedback signal Pf)=kp×Vd+ki×Pd, where kp and ki are gain values of the PI controller 32.

In the above embodiments, the actuating and transmitting device 38 comprises a motor actuating integrated circuit 380, a DC motor 381 and a transmission mechanism 382. The transmission mechanism 382 comprises a gear set 3820 and a transmission belt 3821. In response to the first control signal S1 and the second control signal S2, the motor actuating integrated circuit 380 generate a driving voltage signal to the drive the DC motor 381. An exemplified driving voltage signal is a pulse width modulation (PWM) signal. Meanwhile, the transmission belt 3821 is driven by the DC motor 381 to transmit the printer head 39 to move. In a preferred embodiment, the printer head 39 is an inkjet head of a printing apparatus.

From the above description, the feed forward controller 33 will directly output a control voltage according to the speed command value V issued from the path planning unit 30 and the constants determined by the system identification. This control voltage is advantageous to compensate the counter-electromotive force (voltage) required for the DC motor 381 at the constant speed and the voltage required for resisting the kinetic friction between the gear set 3820 and the transmission belt 3821. As a consequence, the position error and the speed error resulted from the feedback signals are effectively reduced. Under this circumstance, the gain values of the PI controller 32 can be set low, so that the systematic stability is enhanced and the speed error for constant speed control is decreased. Due to the increased response speed and the enhanced systematic stability, the speed error for constant speed control of the inkjet head is reduced.

The present invention is illustrated by referring to a printing apparatus. Nevertheless, the present invention can be applied to other apparatuses having the printing functions, for example a multifunction peripheral or a facsimile machine.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An actuating control device for use between a printer head and an actuating and transmitting device of a printing apparatus, said actuating control device comprising:

a path planning unit issuing a position command value and a speed command value;

a feedback unit communicated with said printer head and generating a position feedback signal and a speed feedback signal according to the position and the speed of said printer head;

a proportional-integral controller communicated with said path planning unit, said feedback unit and said actuating and transmitting device, and generating a first control signal to be transmitted to said actuating and transmitting device according to the difference between said position command value and said position feedback signal and the difference between said speed command value and said speed feedback signal; and a feed forward controller communicated with said path planning unit and said actuating and transmitting device, and generating a second control signal to be transmitted to said actuating and transmitting device according to a computation on said speed command value, wherein said printer head is driven to move by said actuating and transmitting device in response to said first control signal and said second control signal.

2. The actuating control device according to claim 1 wherein said feedback unit is communicated with an optical encoder and an optical ruler for said printer head, and said optical encoder and said optical ruler respond to the position and the speed of said printer head.

3. The actuating control device according to claim 1 wherein said first control signal issued from said proportional-integral controller is obtained by means of an equation: said first control signal=kp×(said speed command value−said speed feedback signal)+ki×(said position command value−said position feedback signal), where kp and ki are gain values of said proportional-integral controller.

4. The actuating control device according to claim 1 wherein said second control signal issued from said feed forward controller is obtained by means of an equation: said second control signal=c1×said speed command value+c2, where c1 and c2 are constants determined from the system identification involving said actuating and transmitting device.

5. The actuating control device according to claim 1 wherein said actuating and transmitting device comprises a DC motor and a transmission mechanism.

6. The actuating control device according to claim 5 wherein said transmission mechanism comprises a gear set and a transmission belt.

7. The actuating control device according to claim 1 wherein said printer head is an inkjet printer.

* * * * *

UNITED STATES PATENT AND TRADEMARK OFFICE

CERTIFICATE OF CORRECTION

PATENT NO. : 7,131,779 B1
APPLICATION NO. : 11/435258
DATED : November 7, 2006
INVENTOR(S) : Yu-Hsien Lin It is certified that error appears in the above-identified patent and that said Letters Patent is hereby corrected as shown below:

In column 1, line 31, please delete "motor 2 described above." and replace with -- motor 12 described above --

Signed and Sealed this

Twenty-seventh Day of March, 2007

JON W. DUDAS
*Director of the United States Patent and Trademark Office*